US006238331B1

(12) United States Patent
Cox et al.

(10) Patent No.: US 6,238,331 B1
(45) Date of Patent: May 29, 2001

(54) CENTRIFUGAL SEPARATOR WITH SEPARATION FUNNEL

(75) Inventors: Ian M Cox, Yeovil; Andrew L Samways, Dorchester, both of (GB)

(73) Assignee: Filterwerk Mann + Hummel GmbH, Ludwigsburg (DE)

( * ) Notice: Subject to any disclaimer, the term of this patent is extended or adjusted under 35 U.S.C. 154(b) by 0 days.

(21) Appl. No.: 09/486,182

(22) PCT Filed: Aug. 26, 1998

(86) PCT No.: PCT/GB98/02568

§ 371 Date: Feb. 23, 2000

§ 102(e) Date: Feb. 23, 2000

(87) PCT Pub. No.: WO99/11381

PCT Pub. Date: Mar. 11, 1999

(30) Foreign Application Priority Data

Sep. 3, 1997 (GB) ..... 9718563

(51) Int. Cl.[7] ..... B04B 7/12; B04B 9/06

(52) U.S. Cl. ..... 494/49; 494/67

(58) Field of Search ..... 494/24, 36, 43, 494/49, 64, 65, 67, 84, 901; 210/168, 171, 232, 360.1, 380.1, 416.5; 184/6.24

(56) References Cited

U.S. PATENT DOCUMENTS

| | | | | |
|---|---|---|---|---|
| 2,865,562 | * | 12/1958 | Burke . | |
| 3,432,091 | * | 3/1969 | Beazley . | |
| 3,666,170 | * | 5/1972 | Cacciabue et al. . | |
| 3,784,092 | * | 1/1974 | Gibson . | |
| 4,284,504 | * | 8/1981 | Alexander et al. | 210/168 |
| 4,346,009 | * | 8/1982 | Alexander et al. . | |
| 4,400,167 | * | 8/1983 | Beazley et al. | 494/49 |
| 5,575,912 | * | 11/1996 | Herman et al. | 210/380.1 |
| 5,637,217 | * | 6/1997 | Herman et al. | 210/168 |
| 5,683,342 | * | 11/1997 | McNair | 494/49 |

FOREIGN PATENT DOCUMENTS

| | | | | |
|---|---|---|---|---|
| 1919976 | | 1/1971 | (DE) . | |
| 278161 | * | 10/1927 | (GB) | 494/901 |
| 732132 | * | 6/1955 | (GB) . | |
| 1036661 | * | 7/1966 | (GB) . | |
| 258272 | * | 12/1969 | (SU) | 494/49 |
| 633609 | * | 11/1978 | (SU) | 494/901 |
| 99/11381 | * | 10/1927 | (WO) . | |
| 9109251 | | 6/1991 | (WO) . | |
| 9622835 | | 8/1996 | (WO) . | |
| 98/36846 | * | 8/1998 | (WO) . | |

* cited by examiner

*Primary Examiner*—Charles E. Cooley
(74) *Attorney, Agent, or Firm*—Nixon & Vanderhye P.C.

(57) ABSTRACT

A self-powered centrifugal separator for removing particulate contaminants from engine lubricant includes a rotor canister which is spun at high speed about a vertical axle by ejection of the lubricant supplied to the canister at elevated pressure by way of apertures in a bearing tube near the upper end of the canister. The canister is separated into upper separation chamber and lower outflow chamber by an annular partition wall which defines a transfer aperture between the chambers by its radially inner edge. The edge of the partition wall also supports concentrically within the separation chamber a separation funnel arrangement having an inclined surface supporting alternate separation ribs and scavenging apertures. Liquid entering the separation chamber is directed radially outwardly and under pressure gradient moves inwardly along the inclined surface. The ribs stand up sharply and create eddies which effect separation of particulate contaminants and their deposition at the surface. Centrifugal forces carry such deposited materials through the scavenging apertures to deposit on the peripheral wall of the canister.

19 Claims, 8 Drawing Sheets

CENTRIFUGAL SEPARATOR WITH SEPARATION FUNNEL

This invention relates to centrifugal separation apparatus for separating particulate contaminants from liquids, such as engine lubricants, passed therethrough and in particular relates to rotor containers used within such apparatus to perform the actual separation and retention of such contaminants.

BACKGROUND

Centrifugal separators are well known for use within the lubrication systems of vehicle internal combustion engines as efficient means for removing very small particulate contaminants from the constantly recirculated liquid lubricant over a long period of operation. Such centrifugal separators are usually of the self-powered type, in which a separation rotor comprising a canister is supported for rotation about a rotor axis within a housing, the canister being supplied with liquid lubricant at elevated pressure along the axis and said liquid-being forced from the base of the canister (or other peripheral wall) by way of jet reaction nozzles, the reaction to said ejection causing the rotor canister and liquid within it to spin at high speed about the axis and thereby cause solid particles to migrate from the liquid passing through the canister and agglomerate on the peripheral walls thereof. The reaction nozzles are directed substantially tangentially with respect to the rotation axis, at least in a plane orthogonal to the axis, so that jets of liquid which leave the rotor canister are instantaneously tangential to the fastly spinning rotor.

It will be appreciated that the efficiency of separation is inter alia dependant upon the quantity of liquid lubricant passed therethrough in a given time and the time for which the liquid remains therein in passing through, and also upon the rotation speed of the rotor canister and contained liquid, which is in turn dependant upon the pressure drop between supply and housing and the dimensions of the nozzles, within the constraints of such nozzle dimensions/pressure drops providing sufficient torque to overcome resistance to commencement of, and continuation of, rotation.

To this end, it is commonplace to have the rotor canister divided internally by way of a radially inwardly extending partition wall which defines an outflow chamber in the vicinity of the reaction nozzles that is distinct from a separation chamber in which said particulate contaminants are separated from the input liquid and retained; the outflow chamber and reaction nozzles are protected from said separated contaminants by a transfer aperture between the chambers radially inwardly of the partition wall, that is, surrounding the rotation axis.

It is also known to have formed in the end wall of the rotor canister that bounds the separation chamber, usually the upper wall, an array of radially extending embossed ribs which by their axial extent or length relative to the wall provide strengthening for the canister wall against elevated internal pressures and also provide shallow troughs between adjacent ribs whereby liquid which enters the canister near to said wall can be accelerated by the ribs both in a circumferential direction, that is, the direction about the axis in which the ribs are travelling, and in a radial direction towards the outer peripheral side wall of the canister where circumferential speeds are higher and centrifugal separation forces higher, although this achieves less than satisfactory results in practice.

Such traditional designs of rotor canisters, whilst structurally simple and cheap to manufacture (particularly relevant when desired as single-use, throw-away, items) are operated below optimum efficiency in terms of separation. Patent specification No WO 96/22835 summarises such a typical centrifugal separator rotor canister structure and disadvantages thereof, inter alia, notwithstanding the presence of such radial ribs at the end wall the tendency for injected liquid to respond to the radial pressure gradient and flow lengthwise (axially) along a 'short circuit' path close to the rotation axis rather than at radially outer regions where circumferential speeds and separation forces are stronger, before describing arrangements aimed at overcoming such disadvantages by way of structural elements within the canister that constrain the liquid to flow by way of a more radially outward part of the canister space.

The above mentioned specification particularly describes separator rotor canister arrangements in which the liquid is injected into the canister separation chamber from the rotation axis towards one (upper) end thereof and is passed to the outflow chamber at the other end thereof, also close to the rotation axis, but the separation chamber contains a structure including a stack of spaced cones, by way of which liquid can flow radially inwardly towards said axial region, and, between the structure and end of the chamber an array of radially outwardly divergent channels defined by way of a circular array of axially directed, radially extending vanes, formed either as inserts adjacent the chamber and/or structure end wall or as ribs pressed from or into the end wall of the container.

The channels defined between such vanes accelerate the liquid that is newly injected in a substantially radial direction into the chamber radially outwardly against the naturally elevated pressure associated with rotation, creating a flow path to the radially outer wall of the canister/separation chamber from where the liquid of said flow can pass between cones of the structure to join the axial flow path adjacent the rotation axis for passage to the outflow chamber. Such a canister is intended to effect an improvement in separation efficiency by constraining the injected liquid to flow at a variety of radial distances from the rotation axis at different circumferential speeds along a tortuous path, said tortuous path increasing the dwell time of the liquid within the canister and thereby improving the opportunity for contaminants to separate from the liquid flow and deposit on any suitable surface within the canister.

However, as the above mentioned specification points out, such radial acceleration of the liquid introduced into the separation chamber near to the rotation axis and upper end of the chamber is achieved at the expense of removing from the rotation canister energy that contributes to its rotation speed and separation efficiency.

Therefore, in conjunction with such radially extending acceleration vanes and acceleration chambers defined thereby, the arrangements described feature an axially extending stack of cones separated from each other in the axial direction by radially extending ribs or vanes which are stated to be acted upon by the radially inwardly returning liquid to return energy to the rotating system whereby the rotation rate of the rotor canister does not suffer. The rotor canister constructions thus described are complex internally in requiring an efficient high-pressure generating radial acceleration system and a separation cone structure which must in part recover energy expended upon said radial liquid acceleration.

SUMMARY OF THE INVENTION

The present inventor perceives the liquid flow arrangement thereof and the internal structure it entails as being unnecessarily and inappropriately complex, particularly with a view to manufacture of an inexpensive and discardable rotor canister, and it is an object of the present invention to provide, for a self-powered centrifugal separator rotor canister, an internal structure that achieves improved efficiency over traditional designs whilst being simple and inexpensive to manufacture. It is also an object of the present invention to provide a rotor canister including such structure and a self-powered centrifugal separator including such a rotor canister.

According to a first aspect of the present invention for a rotor for a self-powered centrifugal separator for separating particulate contaminants from a liquid supplied thereto at elevated pressure, which rotor comprises a canister, arranged to spin about an operationally substantially vertical rotation axis, having (i) an outer, peripheral wall including a peripheral side wall displaced from the axis and at least one end wall, and (ii) an internal partition wall extending radially inwardly from the peripheral wall dividing the canister into a separation chamber at an upper end thereof and an outflow chamber at a lower end thereof and defining at its radially inner periphery a transfer aperture between the separation and outflow chambers, said separation chamber including an inlet aperture to admit contaminated liquid thereto from the rotation axis and the outflow chamber having at least one nozzle spaced radially from said rotation axis to eject liquid from the canister, there is provided a rotor separation funnel arrangement, arranged to be supported coaxially within the separation chamber, having an inclined surface, generated about a longitudinal axis common in use with the rotation axis, and sloping downwardly towards the rotation axis from an upper end concentric with the separation chamber to a lower end apertured so as to direct liquid by way of said inclined surface thereof to the transfer aperture, the inclined surface of the funnel arrangement having alternately arrayed about the rotation axis a plurality of upstanding separation ribs and through-apertures, said separation ribs extending in a direction between the upper and lower ends of the funnel arrangement and defining between adjacent ribs separation channels in which said inclined surface forms deposition surfaces including said through-apertures, said separation ribs being of such height with respect to the deposition surfaces to create, in use within the liquid of the rotating canister that is constrained by the arrangement within the vicinity of the inclined surface, particulate separation eddy currents operable to deposit particulate materials separated from the liquid at the deposition surfaces, said through-apertures comprising scavenging apertures positioned in the separation channels and dimensioned to permit said separated particulate materials that are susceptible to displacement with respect to the deposition surface by the centrifugal forces acting thereon to pass by way of said apertures towards the peripheral side wall of the separation chamber below the funnel arrangement, with at least some of the liquid flowing in the separation channels, said separation funnel arrangement also including return aperture means, comprising at least one return aperture, positioned at or near the lower end of the inclined surface and dimensioned to permit liquid received into the region of the separation chamber below the funnel arrangement by way of the scavenging apertures to flow to said transfer aperture between separation and outflow chambers.

According to a second aspect of the present invention a rotor canister, for a centrifugal separator for separating particulate contaminants from a liquid supplied thereto at elevated pressure, includes a rotor separation funnel arrangement as defined in the preceding paragraph.

According to a third aspect of the present invention a self-powered centrifugal separator for separating particulate contaminants from a liquid supplied thereto and comprising a housing enclosure, an axis extending through the housing enclosure in an operationally substantially vertical orientation and a rotor arranged to receive a liquid at elevated pressure and, in reaction to ejection of the liquid therefrom substantially tangentially, spin about the axis at at least a predetermined minimum speed to effect separation of said contaminant particles from contaminated liquid therein, has said rotor as defined in the preceding paragraph.

Embodiments of the invention will now be described by way of example with reference to the accompanying drawings.

DETAILED DESCRIPTION OF THE DRAWINGS

Figure 1:
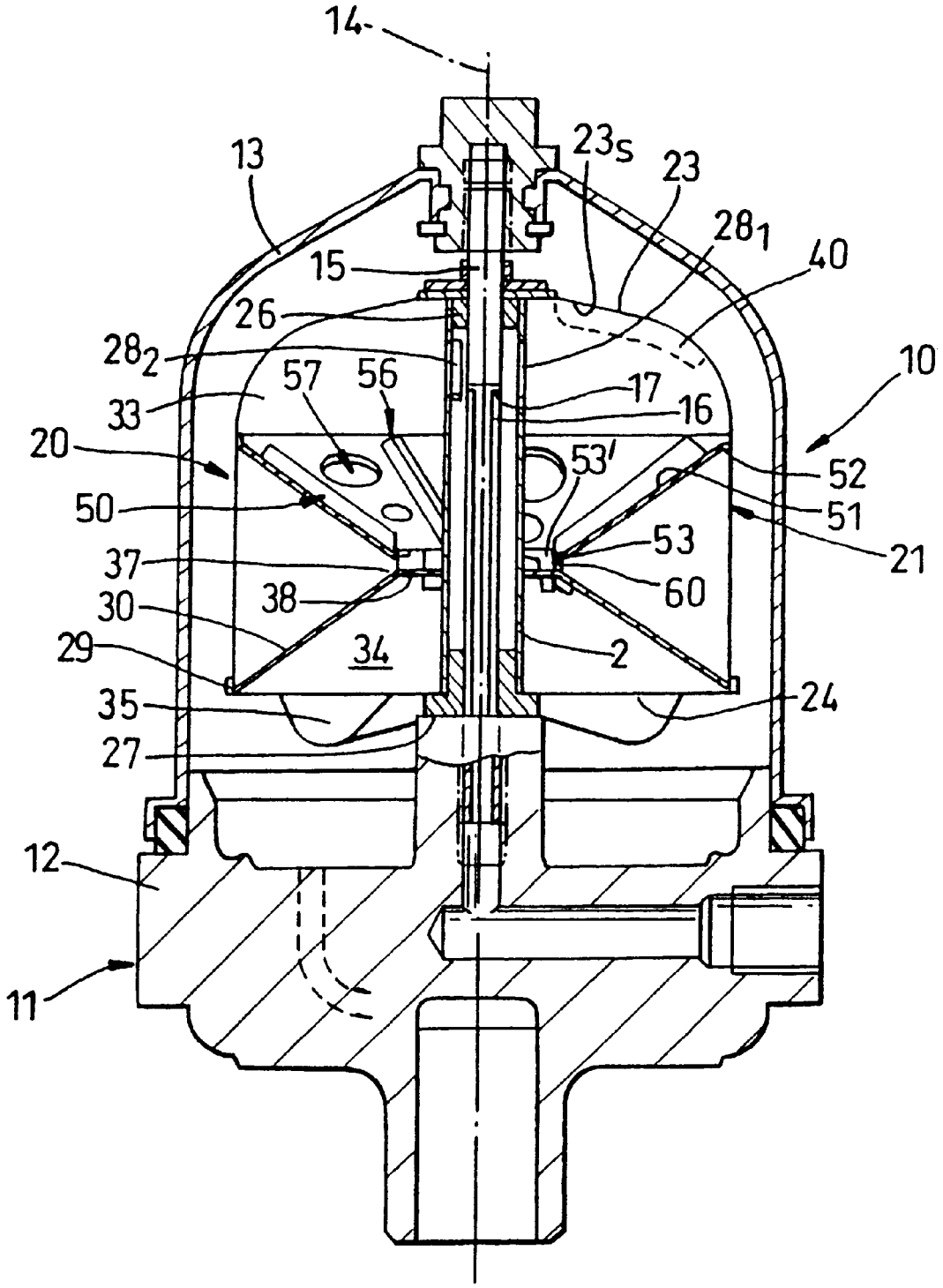
FIG. 1 is a sectional elevation through a centrifugal separator along line 1—1 of FIG. 2(*c*), in accordance with first embodiment of the present invention, showing particularly within a housing, and mounted for rotation in a clockwise direction about a vertical axis therethrough, a first embodiment of rotor canister, also in accordance with the present invention, that is defined radially between an outer peripheral side wall and an inner bearing tube, axially between upper and lower end walls and divided by a partition wall into a lower outflow chamber, having tangentially directed reaction nozzles in the end wall thereof, and an upper inlet and separation chamber that has inlet apertures in the bearing tube and contains a first embodiment of separation funnel arrangement supported on the partition wall and dividing the separation chamber into upper and lower parts, the funnel arrangement having an inclined deposition surface sloping inwardly and downwardly towards the outflow chamber and arrayed at said surface eddy-producing separation ribs and scavenging through-apertures.

Referring to FIG. 1, a centrifugal separator 10 of the type used with an automobile internal combustion engine comprises a housing enclosure 11 formed by a base 12 and removable cover 13 and between which base and cover extends, along an operationally substantially vertical axis 14, a fixed axle 15 that serves to retain the cover with respect to the base in a fluid-tight manner. The axle includes a supply duct 16 along a part of its length and provides passage for engine lubricant, delivered thereto at elevated pressure by the engine lubricant pump (not shown), to ports 17 which open into the housing enclosure. The base 12 is shaped such that it provides a gravity drain into the engine sump (not shown) for liquid in the enclosure.

The axle 15 supports for rotation thereabouts a rotor 20 which comprises a canister for containing the liquid lubricant and, in known manner, is arranged to receive said lubricant from the axle ports at said elevated pressure and eject it from substantially tangentially directed reaction nozzles such that the rotor canister spins at such speed as to effect centrifugal separation of particulate contaminants from the liquid passing therethrough. The rotor canister 20 comprises an outer peripheral wall 21, including axially extending peripheral side wall 22 displaced from the axis 14 and radially extending upper and lower end walls 23 and 24 respectively, and an inner peripheral wall 25 comprising a tubular member fixed to and extending between said end walls. The tubular member 25 is deformed to locate it with respect to through-apertures in the end walls and is arranged to carry bearing bushes 26, 27 at its ends to support the rotor with respect to the axle for rotation thereabout, and is consequently referred to also as a bearing tube. The bearing tube has therein apertures $\mathbf{28}_1, \mathbf{28}_2 \ldots$ which direct lubricant delivered by the axle supply duct 16 into the container near to the upper end wall 23 rather than any other part of the housing enclosure.

The upper end wall 23 and peripheral side wall of the canister are formed integrally from a single sheet of metal drawn into the canister shape and secured to the lower end wall 24 by peripheral folded seam 29.

The rotor canister 20 furthermore includes an internal partition wall 30 extending radially inwardly from the seam 29, of which it is conveniently a part, in a upwardly converging conical manner. The partition wall 30 serves to divide the canister 20 into an upper inlet and separation chamber 33 in communication with apertures $\mathbf{28}_1, \mathbf{28}_2, \ldots$ and an outflow chamber 34 in communication with reaction nozzles 35 in the end wall 24, and furthermore defines at its radially inner periphery 37, a transfer aperture 38 between the separation and outflow chambers.

The upper end wall 23, that is the end wall opposite to the outflow chamber, has at its internal surface $\mathbf{23}_s$ an optional array of axial discontinuities 40 formed as embossments pressed at the time of drawing the contained wall to shape, and in particular comprise so-called strengthening and acceleration ribs, radially extending and raised with respect to the internal surface $\mathbf{23}_s$ of the wall, of relatively narrow cross-section and smooth contour side-to-side, within the constraints of being pressed unidirectionally with drawing of the container wall.

The centrifugal separator and rotor canister as thus far described are conventional.

Liquid flowing into the upper region of the separation chamber 33 by way of apertures $\mathbf{28}_1, \mathbf{28}_2 \ldots$ at elevated pressure encounters within the liquid filled chamber a radial pressure gradient created by the rotating body, so that some of the liquid traverses radially over the surface $\mathbf{23}_s$ of the upper end wall 23 to the radially outer regions where the linear (circumferential) speeds are higher and separation more efficient, and the rest of the liquid traverses lesser radial distance before turning to flow towards the transfer aperture 38. That is, axially displaced from the end wall 23, there is a radially inward flow tendency of the liquid caused by the pressure gradient and location of the transfer aperture.

Figure 2A:
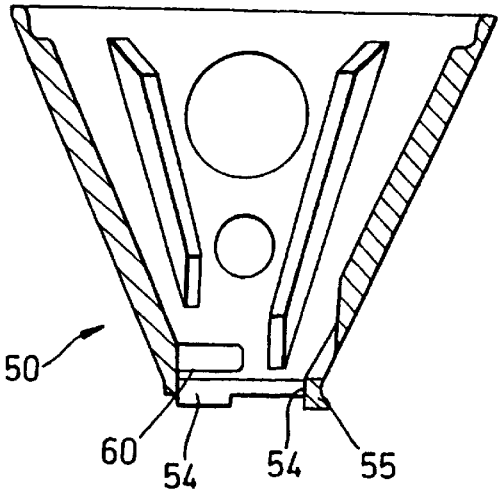
FIGS. 2(*a*) to 2(*c*) are sectional elevation and plan views respectively of the separation funnel arrangement of FIG. 1, the section of FIG. 1 being along the line 1—1 of FIG. 2(*c*) and section of FIG. 2(*b*) being along the line 2(*a*)—2(*a*) of FIG. 2(*c*), FIGS. 3(*a*) and 3(*b*) are respectively sectional elevations of parts of second and third embodiments of centrifugal separator rotor canisters employing second and third embodiments of separation funnel arrangement, FIG. 3(*c*) is a sectional elevation through a modified form of the embodiment of FIG. 1 in which the separation funnel arrangement has its upper end disposed adjacent the upper end wall of the rotor canister and spaced radially from the peripheral side wall, FIG. 4(*a*) is a sectional elevation thorough a fourth embodiment of centrifugal separator, taken along line 4(*a*)—4(*a*) of FIG. 4(*c*), and employing a fourth embodiment of rotor canister containing the separation funnel arrangement of FIGS. 2(*a*)–(*c*) but also, in the upper end wall thereof and arrayed about the axis of rotation, a plurality of downwardly directed axial discontinuities in the form of radially extending acceleration embossed ribs that are also swept circumferentially such that their radially outward regions are displaced in a circumferential direction that is trailing with respect to the direction of rotor rotation, FIG. 4(*b*) is a perspective view of the rotor canister of FIG. 4(*a*), illustrating the trailing directional nature of the acceleration ribs in the rotor canister end wall, FIG. 4(*c*) is a cross section through the rotor canister of FIG. 4(*a*) along the line 4(*c*)—4(*c*) viewed in the direction towards the upper end wall, the sectional elevation of FIG. 4(*a*) being along the line (*a*)—(*a*) of the Figure.
Figure 2B:
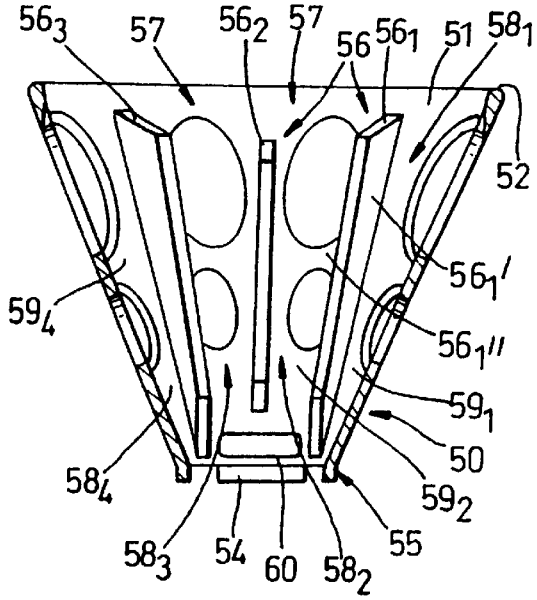
Figure 2C:
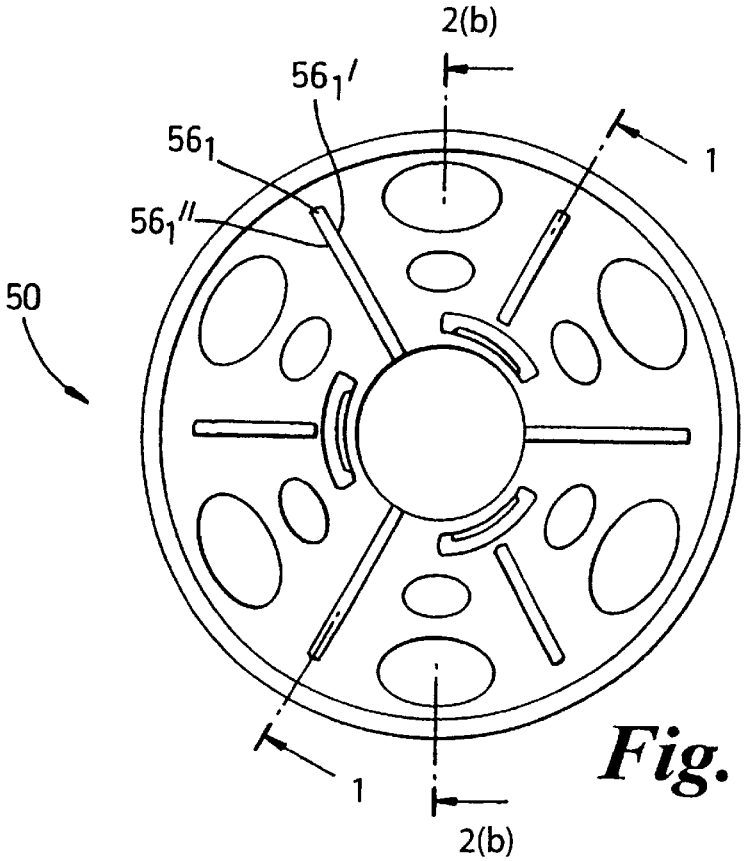

Referring also to FIGS. 2(*a*) to 2(*c*) there is provided within the rotor canister a rotor separation funnel arrangement, indicated generally at 50, which is arranged to be supported coaxially within the separation chamber 33, that is, share a common longitudinal, rotation, axis forming the generation of the funnel. The separation funnel arrangement has an inclined surface 51 that slopes downwardly towards the rotation axis 14, that is, the surface is both upwardly- and radially inwardly-facing, from an upper end 52 in the vicinity of the junction between the peripheral side wall 22 and upper end wall 23 to a lower end 53 apertured by concentric aperture 53' so as to direct liquid by way of the inclined surface to the transfer aperture 38 between the separation and outflow chambers. The inclined surface 51 is substantially flat in section therethrough, that is, extends as a part of a cone of substantially constant included angle at the common rotation axis 14. The upper end 52 conveniently makes contact with the peripheral wall to be constrained thereby to said concentricity and relatively insensitive to any out-of-balance forces manifested at high rotation speed.

The lower end 53 is coextensive with, and in line with, the transfer aperture and the funnel arrangement is supported by the partition wall 30 by way of axially extending leg members 54 extending into the transfer aperture. The funnel arrangement 50 is molded from plastics material and the leg members have molded therewith resilient detent lugs 55, arranged to latch over the end of the partition wall that surrounds the transfer aperture.

The funnel arrangement also has, at the inclined surface 51, a plurality of upstanding separation ribs, indicated generally at 56, and through apertures, indicated generally at 57, arranged alternately about the rotation axis.

The separation ribs $\mathbf{56}_1$, $\mathbf{56}_2$, $\mathbf{56}_3$ . . . extend in a direction between the upper and lower ends of the funnel arrangement in a direction substantially parallel to the rotation axis and define between adjacent ribs separation channels $\mathbf{58}_1$, $\mathbf{58}_2$, $\mathbf{58}_3$ . . . in which the inclined surface forms deposition surfaces $\mathbf{59}_1$, $\mathbf{59}_2$, $\mathbf{59}_3$ . . . including the through-apertures 57.

The separation ribs are formed integrally with the inclined surface 51 as part of the molded body and in a circumferential direction, that is, in a direction around the axis 14, are each thin in relation to their height and length orthogonally thereto. The length of each rib, such as rib $\mathbf{56}_1$, is defined by circumferentially facing side walls $\mathbf{56}_1$' and $\mathbf{56}_1$" that extend substantially perpendicularly to the inclined surface 51, ribs being of such height with respect to the adjacent deposition surfaces $\mathbf{59}_1$, $\mathbf{59}_2$ . . . as to create within liquid that is constrained by the arrangement within the vicinity of the inclined surface particulate-separation eddy currents of a strength to encourage separation of particulate materials from the liquid and deposit such separated materials at the deposition surfaces. In this respect it has been found that separation ribs that are axially extending and have steep, circumferentially facing side walls perform well in effecting particulate separation.

The through-apertures 57 comprise scavenging, or particulate clearance, apertures positioned within the respective separation channels $\mathbf{58}_1$, $\mathbf{58}_2$ . . . In this embodiment there are two holes in each channel positioned and dimensioned such that particulate materials, separated from the liquid and settling on the deposition surfaces $\mathbf{59}_1$, $\mathbf{59}_2$ . . . , but also susceptible to displacement with respect to those surfaces by along-surface components of centrifugal forces acting on the materials, can pass by way of said apertures towards the peripheral side wall 21 of the separation chamber below the separation funnel arrangement. That is, the apertures serve to effect scavenging of deposited materials from the deposition surfaces.

The ease or difficulty with which such deposited particulate materials are scavenged from these parts of the inclined surface by such centrifugal forces depends upon the nature of the materials, that is, how well they adhere to the surfaces and/or each other, and upon the angle of inclination of the surface.

Clearly any particulate materials tending to separate from the liquid in the vicinity of such scavenging apertures may pass directly therethrough, as may at least some of the liquid flowing in the separation channels and disturbed by the separation ribs. Contaminated liquid passing through such scavenging apertures is, of course, still susceptible to the normal centrifugal separation forces found within such a rotor canister and any particulate contaminants separated therefrom are collected on the peripheral side wall 21 in the usual manner.

It will be appreciated that if all of the liquid that is fed into the upper region of the separation chamber 33 is caused to flow to the transfer aperture 38 by way of the ribbed inclined surface of the separation funnel arrangement there will be little flow axially at radially outer regions below the funnel arrangement to make use of 'conventional' centrifugal separation.

Accordingly, to accommodate a degree of liquid flow through the scavenging apertures that is not insignificant, the arrangement also includes return aperture means, indicated generally at 60, comprising an array of return apertures $\mathbf{60}_1$, $\mathbf{62}_2$ . . . positioned near the lower end of the inclined surface.

The return apertures are dimensioned, in terms of circumferential width about the inclined surface rather than axial height along it, to permit liquid received into the lower region of the separation chamber by way of the scavenging apertures to flow back to the transfer aperture 38 between separation and outflow chambers. It will be appreciated that the extent of flow by way of said scavenging apertures and lower region of the separation chamber is governed by the area of the return aperture means, which area may be pre-defined, or possibly made variable in operation, to set the level of such flow in accordance with prescribed or prevailing operating conditions.

It will be seen that the presence of the axially extensive return apertures requires that those separation ribs aligned with the return apertures ($\mathbf{56}_2$, $\mathbf{56}_4$ . . . ) are of shorter length than the intervening ribs ($\mathbf{56}_1$, $\mathbf{56}_3$ . . . ). Also, the positioning and style of the return apertures permits for ready molding of the funnel arrangement as a unitary body by having the legs and their terminating detent lugs formed by way of a mold which can create, and pass through, the return apertures with an axial, mold-releasing, direction. Similarly, the scavenging apertures may be formed, as shown particularly in FIG. 2(*b*), with the upper regions extending in axial direction to facilitate such molding and mold release. Also, the scavenging apertures may be formed, as illustrated in FIG. 2(*c*) to have a shape which is circular when projected onto a plane extending parallel to the axis, that is, circular about an axis extending perpendicular to the rotation axis 14.

Although such molding of the funnel arrangement as a unitary body from plastics material is convenient and relatively inexpensive, it will be appreciated that it may be assembled from discrete parts and/or formed from different materials.

Likewise, the numbers, dispositions and shapes of the component parts may be varied to suit, the obvious ones being the number and dimensions of the separation ribs and scavenging apertures, and the angle of inclination of the inclined surface 51. In particular, the inclination with respect to the deposition surfaces of one or both of the circumferentially facing sides of the separation ribs may vary, as may the height and widths of the ribs and their direction between the upper and lower ends of the funnel arrangement.

It will be appreciated that the size of the scavenging apertures is dictated by the need to permit the passage of particulate materials, separated out of the liquid by the actions of the separation ribs, without the apertures becoming blocked thereby, at least until the accumulation on the peripheral side wall below the funnel arrangement occludes them. To this end, the inclined wall 51 of the funnel arrangement may be of a highly perforated, or mesh-like material, having suitably sized scavenging apertures and with the separation ribs overlying some of the apertures if necessary.

It will be appreciated that the surface may be other than conical, such as dished or bowl-shaped. The lower end of the funnel arrangement may also be adapted such that its relationship with the partition wall 30 and transfer aperture 38 differs.

Figure 3A:
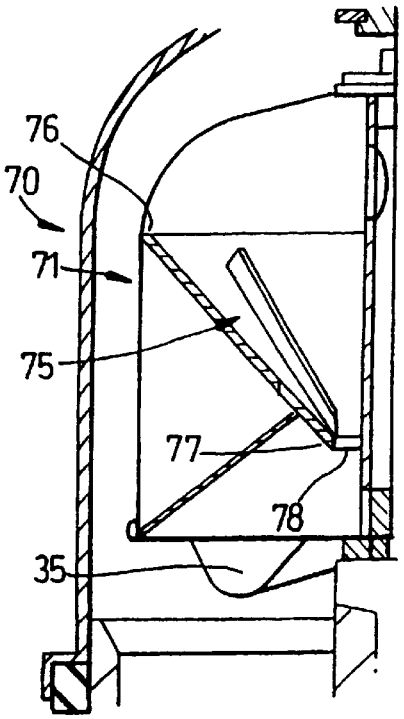
Figure 3B:
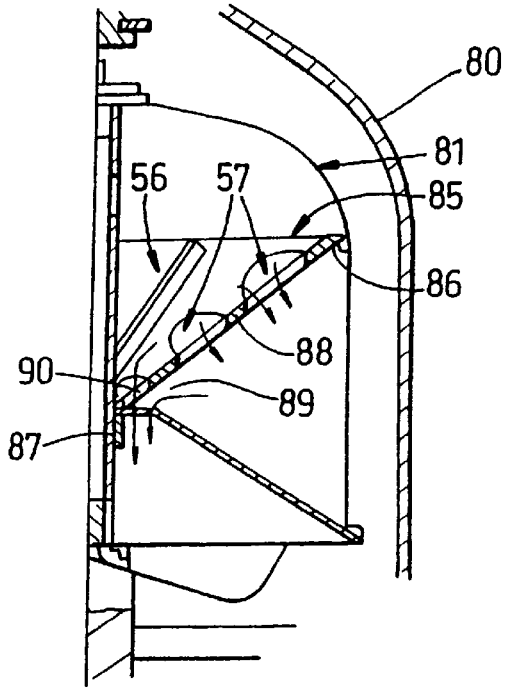
Figure 3C:
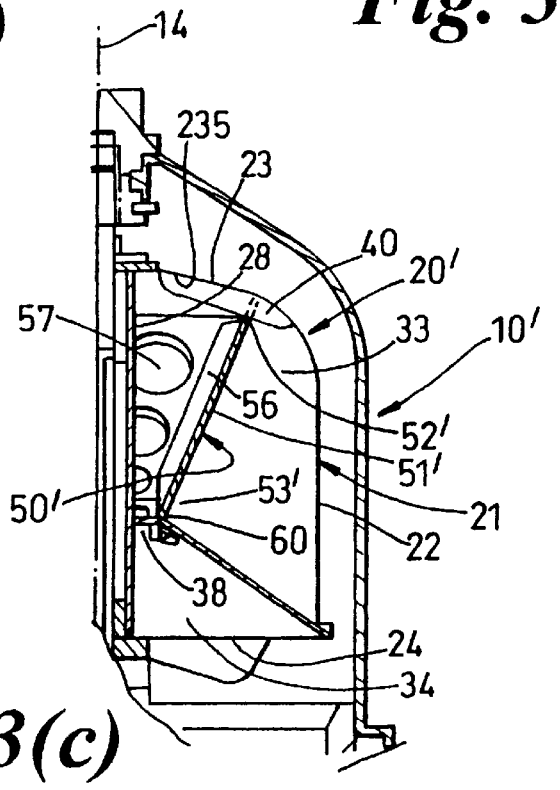

Referring to FIG. 3(*a*), in a sectional elevation through a second embodiment of centrifugal separator 70 including a rotor 71, both of which are generally similar to those shown in FIG. 1, the rotor separation funnel arrangement 75 has its upper end 76 in contact with the outer peripheral wall and has at its lower end 77, a circular aperture 78 that is smaller than that defined by the partition wall 30 such that the funnel arrangement sits in the erstwhile transfer aperture by virtue of its truncated conical shape and defines the effective transfer aperture by the dimensions of its lower end aperture 78.

Referring to FIG. 3(*b*), in a third embodiment of centrifugal separator 80 including a rotor 81, both of which are also generally similar to those shown in FIG. 1, the rotor separator funnel arrangement 85 has its upper end 86 also held concentrically by contact with the peripheral side wall but has its lower end 87 formed to surround, and support the arrangement in relation to, the bearing tube 25 such that the inclined surface part 88 is axially spaced above the end of the partition wall and an annular return aperture means 89 is defined thereby between them. Instead of the lower end of the inclined surface terminating in a circular opening which surrounds the bearing tube and forms an annular aperture coextensive with the transfer aperture 38 defined by the partition wall, the lower part of the inclined wall has a functionally equivalent plurality of through-apertures 90 arrayed about the bearing tube.

In all of the above-described embodiments the upper end 52, or 76, or 86 of the inclined wall of the funnel arrangement is dimensioned to make contact with the peripheral side wall of the canister, which is convenient as a means for ensuring that the upper part of the funnel arrangement is held concentrically and not liable to introduce out-of-balance vibrations at the very high rotation speeds of operation, particularly as deposits of separated particulate materials lie up indeterminate on the deposition surface before scavenging. It will be appreciated that the upper end does not have to form a closure or seal with the wall to prevent the passage of liquid between the funnel arrangement and wall and the upper end may, if desired, be spaced from the peripheral wall by supporting spacers or the like (not shown), or, if it is sufficiently strong and vibration resistant, may be spaced totally without any support from the peripheral wall.

Likewise the upper end of the funnel arrangement may be held concentrically by contact with the upper end wall rather than the peripheral side wall, notwithstanding the presence of acceleration ribs 40. Such a configuration, illustrated in sectional elevation in FIG. 3(*c*) is a modification 10' of the separator 10 of FIG. 1. The rotor 20' has a separation funnel arrangement 50' with a smaller included angle and the upper end 52' makes concentricity-maintaining contact with the surface $\mathbf{23}_s$ of the upper end wall 23. Insofar as the surface is embossed with acceleration ribs 40, the upper end abuts the surface of the ribs with acceleration troughs defined therebetween, but the upper end may be profiled to fit around such ribs if desired.

Such an embodiment in which the upper end of the separation funnel arrangement is in the vicinity of the canister end wall may find particular use in a rotor canister construction that is intended for dis-assembly, cleaning and re-assembly; the upper end of the funnel arrangement, in remaining spaced from the peripheral side wall upon which contaminant deposits aggregate, avoids entrapment by such aggregated deposits and difficulties of dis-assembly.

As mentioned above, the liquid acceleration ribs 40 provided by axial discontinuities in the canister end wall are optional; without them there will be some radially outward flow of liquid entering the separation chamber and which liquid will tend to flow along the separation channels of the funnel arrangement, and notwithstanding any such flow, the upper part of the separation chamber is filled with liquid which is bound by the ribbed and apertured surface of the separation funnel, whereby such particulate-separating eddy currents are created.

Where such ribs 40 or their equivalents are employed, they function not only to strengthen the walls of the canister but also define troughs therebetween whereby more of the liquid entering the separation chamber near the end wall is directed towards the radially outer edge of the end wall and peripheral side wall where centrifugal forces are higher and potentially effect better separation of particulate contaminant materials from the liquid. In combination with the separator funnel arranged described above, this increases the proportion of newly introduced liquid that flows along the full length of the inclined surface.

However, overcoming such radial pressure gradient that exists within the rapidly spinning rotor canister to drive liquid towards the outer peripheral wall means that such radially-extending acceleration ribs increase the amount of liquid at the high-pressure, radially outer region, at the expense of absorbing energy from the rotating canister system to accelerate the liquid, with a consequential reduction in the rotation speed.

Co-pending application No. 9718564.9 describes a self-powered centrifugal separator systems in which the rotor canister has at the end of the container opposite the outlet chamber, at the internal surface thereof, an array of axial discontinuities each extending radially and with at least some of said axial discontinuities also extending circumferentially such that at their radially outer regions they are displaced circumferentially with respect to regions radially inwardly thereof in a direction that is trailing with respect to the rotation direction of the rotor that results from ejection of liquid of the canister.

Such a rotor canister end wall structure is believed particularly advantageous in combination with the above-described rotor separation funnel arrangement as it effects a gentle acceleration of newly injected liquid to the radially outer region at the junction of end wall and outer peripheral wall and extracts less energy from the rotating canister in doing so.

Figure 4A:
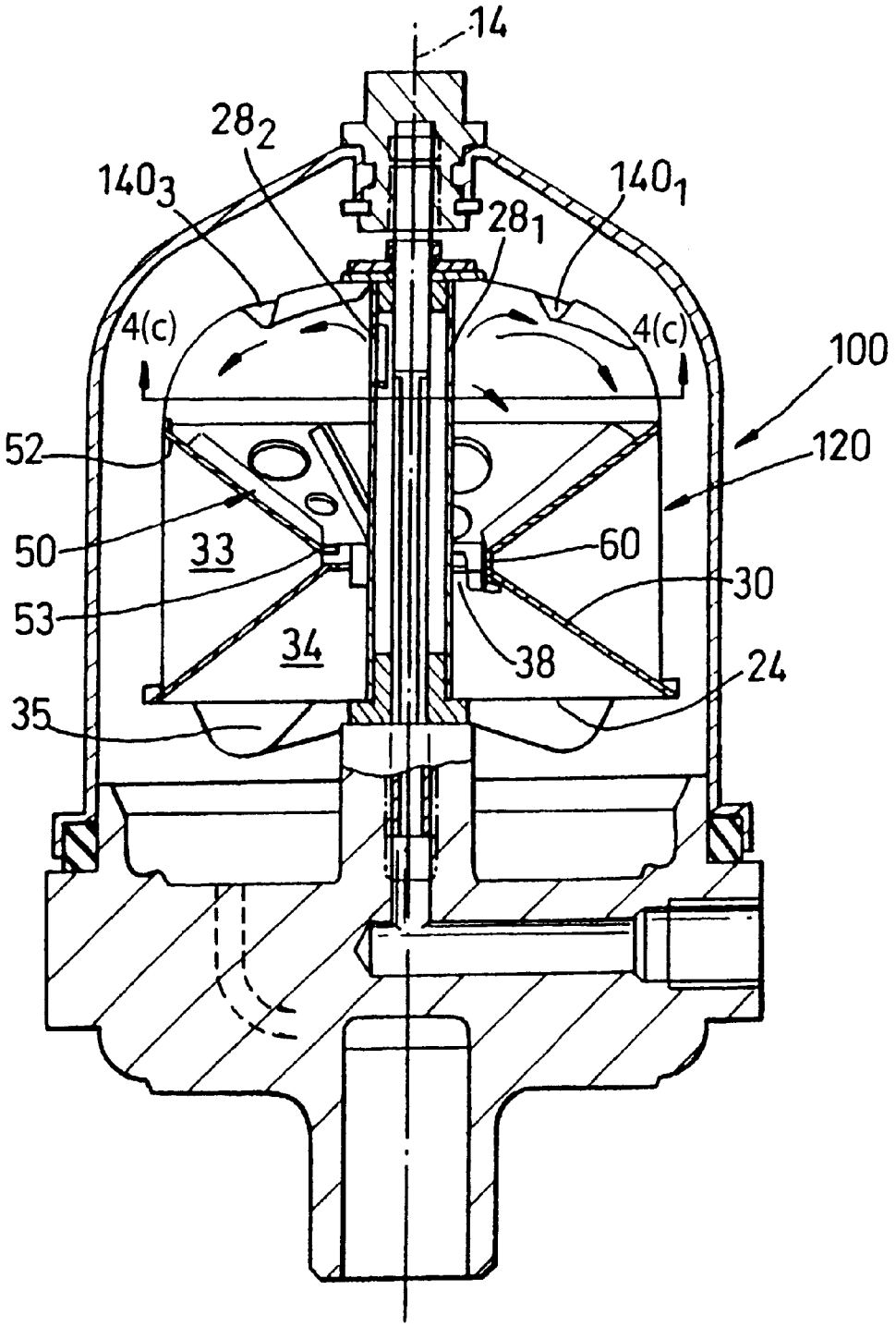
Figure 4B:
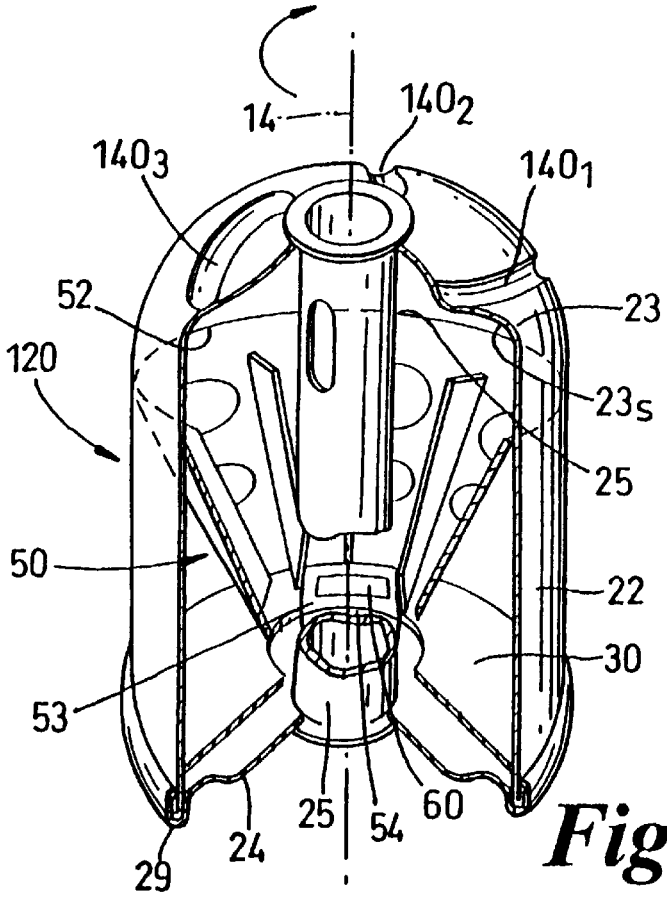
Figure 4C:
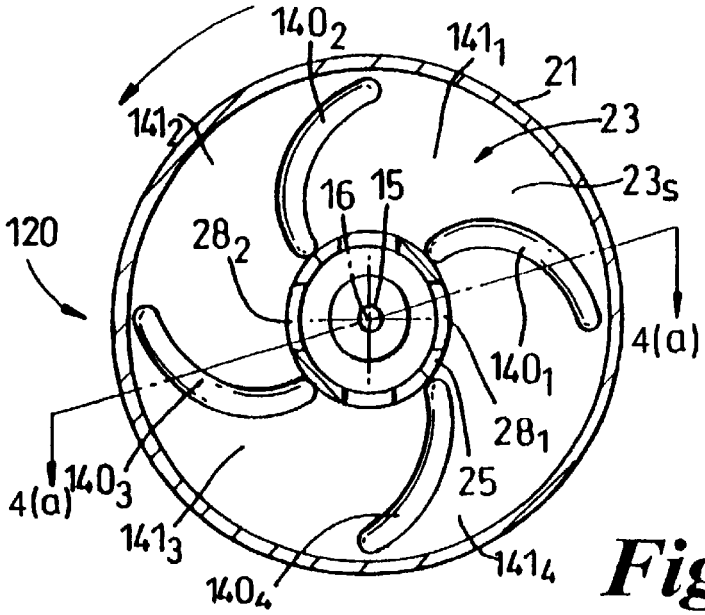

In a fourth embodiment of centrifugal separator 100 in accordance with the present invention, shown in sectional elevation in FIG. 4(*a*), the rotor canister therefor 120 is also shown in partly-cut -away perspective view in FIG. 4(*b*) and in cross-section view in FIG. 4(*c*), the FIG. 4(*c*) being along the line 4(*c*)—4(*c*) of FIG. 4(*a*) and the FIG. 4(*a*) being along the line 4(*a*)—4(*a*) of FIG. 4(*c*).

Those parts of the separator and rotor canister which correspond to the separator and canister of FIG. 1 are given like reference numbers and are not described further. The peripheral difference is that the radially extending axial discontinuities 40 of the rotor canister 20, that define acceleration ribs are replaced by an array of acceleration ribs $\mathbf{140}_1, \mathbf{140}_2, \ldots$, also formed by embossment of the end wall, and between which are defined acceleration troughs $\mathbf{141}_1$, $\mathbf{141}_2$, $\mathbf{141}_3 \ldots$ The acceleration ribs extend between the radially inner and outer edges of the end wall, as defined by the junction with the peripheral side wall 22 and bearing tube 25, having not only a radial component of direction but also a circumferential component as a smooth and consistent curvature along their entire lengths such that at their radially outer regions they are displaced circumferentially with respect to regions inwardly thereof in a direction that is trailing with respect to the rotation direction of the rotor canister that results from ejection of liquid lubricant from the container. Looked at alternatively, the radially outer regions are displaced with respect to the radially inner regions in the same circumferential direction as liquid is ejected from the outflow chamber by way of the reaction nozzles.

Liquid is supplied to the rotor canister at elevated pressure and enters the separation chamber 33 in the vicinity of the end wall 23 in a substantially radial direction relative to the rotating canister and at least some of it enters the shallow troughs $\mathbf{141}_1$, $\mathbf{142}_2$, . . . formed between adjacent ribs $\mathbf{140}_1$, $\mathbf{140}_2$, . . . where it is acted upon by the acceleration ribs to the extent that it is given components of motion both circumferentially about the rotation axis and radially towards the outer peripheral side wall.

The circumferentially trailing sweep of the axial displacement ribs elongates the effective length of each channel or radial distance to the vicinity of the outer peripheral side wall and subject the liquid to corresponding lower acceleration forces than are seen with straight radial axial acceleration ribs.

The canister, and any liquid already in it, moves in a circumferential direction and relative to which the newly introduced liquid lags. However, instead of the liquid immediately and forcibly encountering circumferentially moving, and radially extending, acceleration ribs which apply both circumferential and radial components of motion to the liquid in a short time interval, the liquid encounters circumferentially moving, but trailing, acceleration ribs which apply forces to the liquid to change its velocity from principally radial to principally circumferential over a longer flow path. The liquid is subjected to a lower level of acceleration force thereon, which force has to be obtained from the energy of the rotating canister. To this end it would appear that less rotation energy is absorbed from the rotating canister in providing radial movement of the liquid relative to the end wall 23.

Furthermore, the pressure gradient in the liquid in the direction along the curved path it takes in the troughs, that is, following the line of the acceleration ribs, is found to be less that with straight, radially-extending, ribs and thus notwithstanding the lower radial forces applied to the introduced liquid that flows between these ribs, there is less (pressure gradient) opposition to the flow, and the structure departs from the perceived wisdom that the introduced liquid has to be accelerated forcefully to overcome considerably higher pressure at the radially outer regions if flow is to occur by way of these radially outer regions of the separation chamber rather than along a short-circuit path as discussed above.

Preferably, the curvature of the acceleration ribs is chosen having regard to the anticipated conditions of operation, namely lubricant supply pressure (which is substantially constant at engine operating speeds), rotor rotation rate and rate of flow through the canister, such that the lubricant input to the separation chamber at apertures $\mathbf{28}_1$, $\mathbf{28}_2$ . . . maintains a substantially constant velocity vector as it passes towards the peripheral side wall and changes flow direction from one that substantially radial into the chamber to being substantially circumferential at the peripheral side wall. Furthermore, in keeping with the smooth transition the outer extremities of the acceleration ribs are substantially tangential to the edge of the end wall as defined by the peripheral side wall, and the inner extremities may reach the bearing tube substantially perpendicular to the tube, that is radially and in the same direction as new liquid enters the chamber or in a said trailing circumferential direction.

It will be appreciated that there are a number of ways in which such trailing circumferential curvature of the axial discontinuities may be achieved, both in terms of the shape and disposition of the discontinuities.

Figure 5:
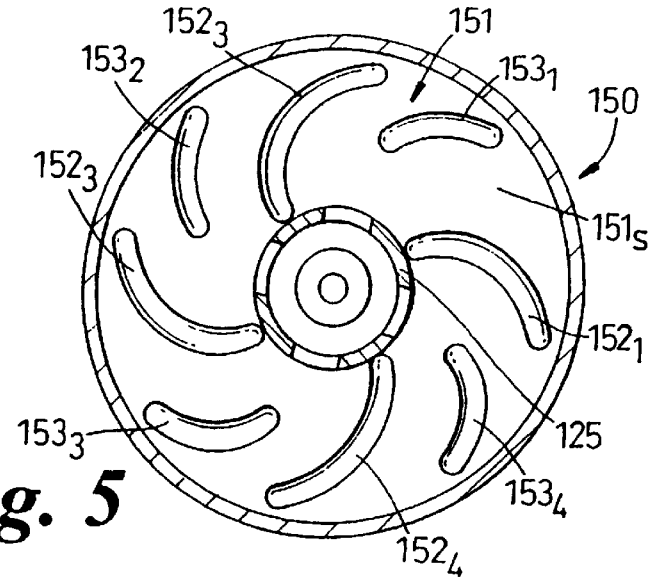
FIG. 5 is a cross section view, similar to that of FIG. 1(*c*), of a fifth embodiment of centrifugal separator canister in which the axial discontinuities comprise an array of full-length acceleration ribs which each extend between the bearing tube at the radially inner end of the end wall and the radially outer end of said end wall and an array of radially shorter acceleration ribs, each disposed between a pair of full length ribs, which extend from the radially outer end of the canister end wall to a termination well short of the axle tube, FIGS. 6 and 7 each show in part cross-section views similar to those of FIGS. 4(*c*) and 5 but of sixth and seventh embodiments respectively of rotor canister wherein the radially inner ends of the acceleration ribs terminate adjacent the bearing tube in a circumferentially trailing direction.

Referring now to FIG. 5, which is a cross section view similar to FIG. 4(*c*) of a fifth embodiment of a rotor canister 150 differing in that in this second embodiment the canister end wall 151 has at its internally facing surface $\mathbf{151}_s$ axial discontinuities comprising an array of full-length acceleration ribs $\mathbf{152}_1$, $\mathbf{152}_2$ . . . , extending between the radially outer and inner edges of the end wall as described above, and between pairs of adjacent ribs, an array of short acceleration ribs $\mathbf{153}_1$, $\mathbf{153}_2$ . . . which at the outer edge of the end wall conform to the curvature of the full-length acceleration ribs but which have their radially inner ends spaced from the radially inner edge of the wall and bearing tube.

Figure 6:
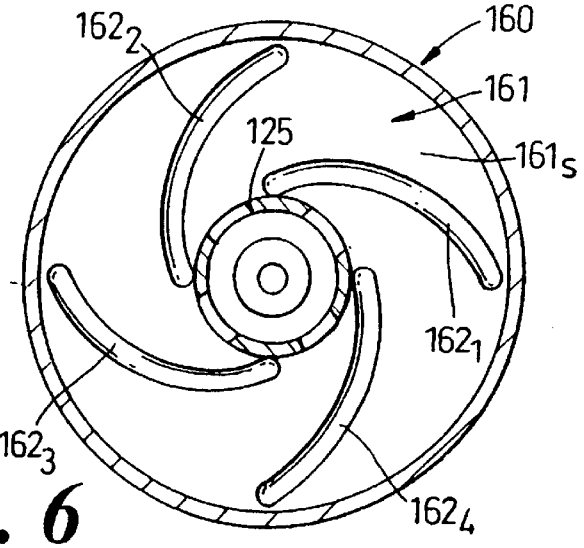

Referring to FIG. 6, in a sixth embodiment 160 seen in cross-section view similar to FIG. 4(*c*), the internal surface $\mathbf{161}_s$ of end wall 161 carries full-length ribs $\mathbf{162}_1$, $\mathbf{162}_2$ . . . whose curvature is such that at their radially inner extremities they are substantially tangential with respect to the inner edge of the end wall and the bearing tube thereat.

Figure 7:
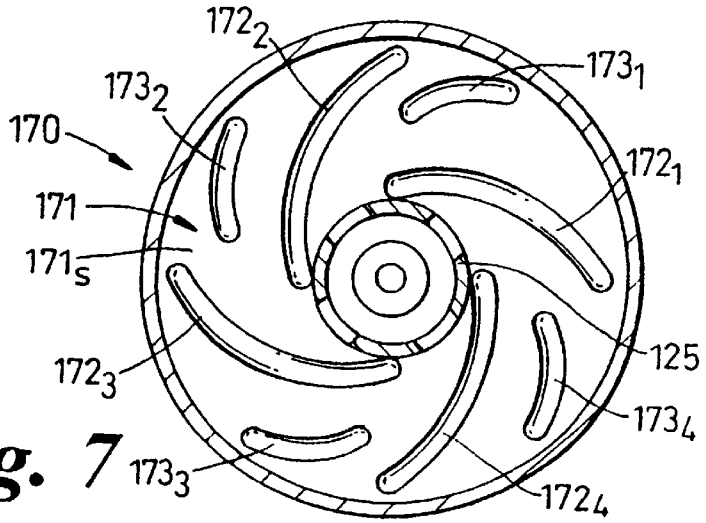

In FIG. 7, in a seventh embodiment 170 that is generally similar to the embodiment 150, the end wall 171 has at its internal surface $\mathbf{171}_s$ full length acceleration ribs $\mathbf{172}_1$, $\mathbf{172}_2$ . . . which are interspersed with short acceleration ribs $\mathbf{173}_1$, $\mathbf{173}_2$ . . . , but wherein the full-length acceleration ribs terminate substantially tangentially with respect to the bearing tube.

Figure 8:
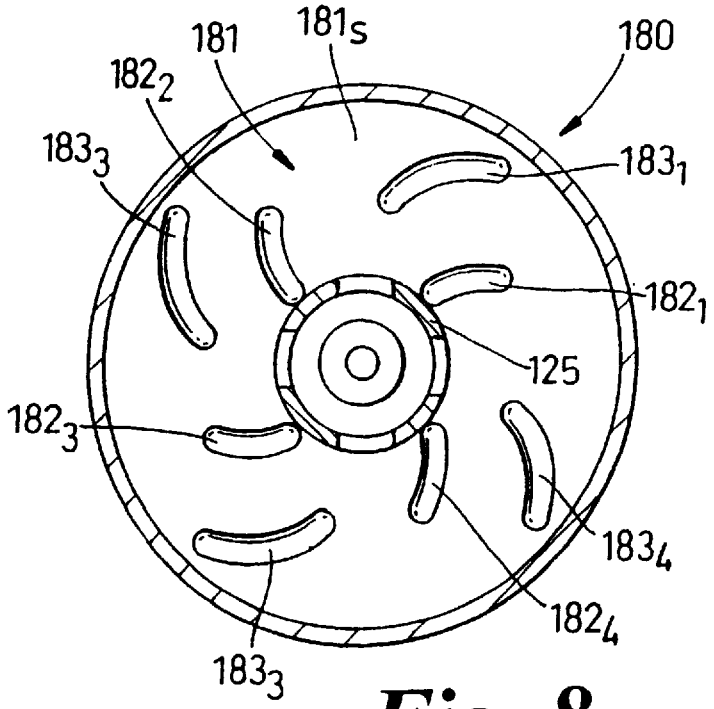
FIG. 8 is a cross-section view, similar to FIG. 4(*c*), of an eighth embodiment of rotor canister in which all of the acceleration ribs only extend part way between the radially outer edge of the end wall and the axle tube.

In an eighth embodiment of rotor canister 180 shown in FIG. 8, all of the axial discontinuities at surface $\mathbf{181}_s$ of end wall 181 are formed by radially short acceleration ribs, there being a radially inner array $\mathbf{182}_1$, $\mathbf{182}_2$, $\mathbf{182}_3$ . . . being surrounded by a circumferentially offset radially outer array of acceleration ribs $\mathbf{183}_1$, $\mathbf{183}_2$,$\mathbf{183}_3$ . . . The extremities of the acceleration ribs are shown in radially overlapping relationship but this may be considered optional.

Figure 9:
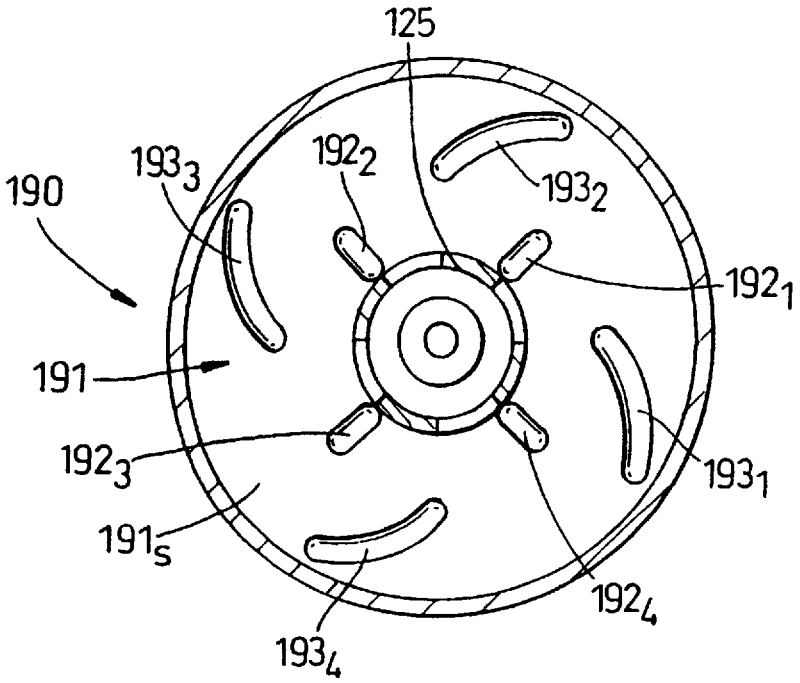
FIG. 9 is cross-section view, similar to FIG. 8, of a ninth embodiment of rotor canister, in which the axial discontinuities comprise radially inner and outer arrays of short radial ribs, those of the inner array extending substantially straight and radial.

Referring to FIG. 9, in a ninth embodiment of rotor canister 190, the axial displacements formed at the end wall 191 and in the internal (to the canister) surface $\mathbf{191}_s$ thereof comprise an outer array of short acceleration ribs $\mathbf{193}_1$, $\mathbf{193}_2$ . . . corresponding to ribs $\mathbf{183}_1$ . . . and an inner array of short acceleration ribs $\mathbf{192}_1$, $\mathbf{192}_2$ . . . which extend for a short distance in a radial direction with little or no trailing curvature. The radially-inner, straight acceleration ribs guide the liquid that enters the canister in a substantially radial direction to the mainly curved troughs $\mathbf{194}_1$, $\mathbf{194}_2$, . . . between adjacent acceleration ribs of the outer array.

Figure 10:
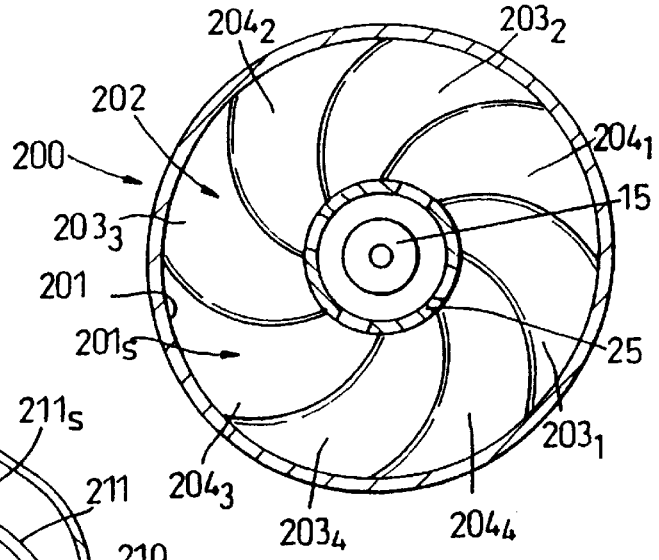
FIG. 10 is a cross-section view, similar to FIG. 4(*c*), of a tenth embodiment of rotor canister in which the axial discontinuities comprise alternate depressed and raised embossed regions of the end wall that are circumferentially extensive and substantially equally dimensioned, and FIGS. 11(*a*) and 11(*b*) are sectional elevation and cross section views respectively, similar to FIGS. 4(*a*) and 4(*c*), of an eleventh embodiment of rotor canister in which the axial discontinuities are defined on a discrete carrier member overlying the end wall as circumferentially thin vanes, the carrier member comprising part of the separation funnel arrangement.

In a tenth embodiment of rotor canister 200, shown in FIG. 10 also as a cross-section view towards the end wall 201 and its internal surface $\mathbf{201}_s$, the array of axial discontinuities, indicated generally at 202, take the form of alternate depressed and raised regions $\mathbf{203}_1$, $\mathbf{203}_2$ . . . and $\mathbf{204}_1$, $\mathbf{204}_2$ . . . respectively that are circumferentially extensive compared to the accelerated ribs described hitherto. The depressed regions $\mathbf{203}_1$ . . . that correspond to the depressed, embossed acceleration ribs being substantially equally dimensioned to the non-depressed regions $\mathbf{204}_1$ . . . that correspond to the troughs between such acceleration ribs.

In all of the above, the axial displacements have been described formed by embossment of the rotor canister metal as it is drawn to shape from a blank thereof. It will be appreciated that whereas such displacement formation may be convenient as part of an existing manufacturing procedure, there are alternatives.

Figure 11A:
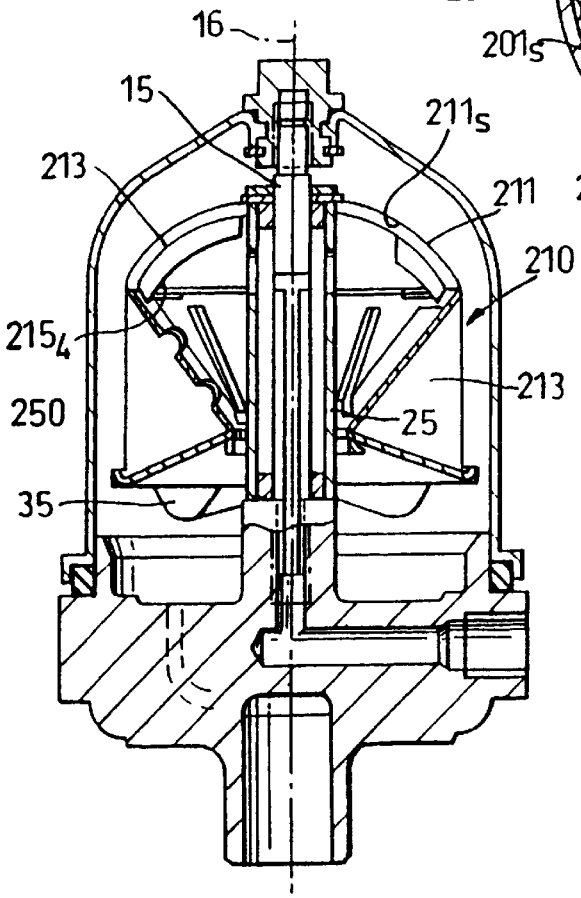
FIG. 11(*a*) is taken along the line 11(*a*)–11(*a*) in FIG. 11(*b*)
Figure 11B:
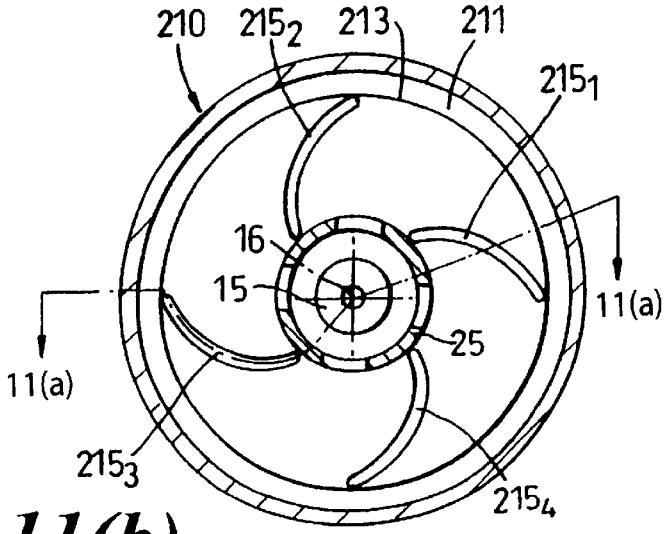

Referring to FIGS. 11(*a*) and 11(*b*) which show sectional elevation and cross-section views respectively, generally similar to those of FIGS. 4(*a*) and 4(*c*), of an eleventh embodiment 210 of rotor canister, the upper end wall 211 has a surface $\mathbf{211}_s$ facing into the separation chamber and overlying that surface a carrier member 213 on which are carried axial discontinuities $\mathbf{215}_1$, $\mathbf{215}_2$ . . . extending thereon in said axial, radial and circumferential directions. Conveniently, the axial discontinuities are formed by acceleration vanes each having thickness in a circumferential direction that is much less than the vane length, and indeed less than the ribs formed by embossment and described above. The acceleration vanes may be formed integrally with the carrier member as a molding or casting of, for example, plastics material or metal, or may be stamped and bent out of a sheet of suitable material. Furthermore, the carrier member 213 may be formed as a part of the separation funnel arrangement 250 which for the most part is identical to the funnel arrangement 50 described above, and may, if practicable, be formed as a unitary molding or assembled as a unitary sub-assembly prior to disposing in the separation chamber.

The numbers, lengths and curvatures of such acceleration vanes may take any of the variety of forms described above, varying in circumferential thickness as well as length and curvature. Also, although it is convenient for such acceleration vanes to extend in an axial direction, that is, perpendicular to the end wall/carrier surface, they may be inclined thereto.

It will be appreciated that notwithstanding the convenience of having the axial displacements, particularly in the form acceleration vanes which are thin in a circumferential direction, formed on a carrier member such as 213, they may be formed by discrete shaped bodies of any material secured directly to the internal surface of the end wall.

Also, the axial displacements have been described above as continuously and smoothly curved substantially along the whole of their extent; it will be appreciated that the curvature along any component part of length may be very shallow or non-existent, is straight, and/or any axial displacement may, along its radial length, comprise a series of straight or nearly-straight segments inclined with respect to each other so as to give, along the whole length, an effective curvature in said circumferentially trailing direction.

It will also be appreciated that although all of the above described embodiments have featured a centrifugal separator rotor canister in which an inner peripheral wall is defined by an apertured bearing tube 25 that rotates as part of the canister about the axle 15, and which bearing tube conveniently defines the radially inner edge of the end wall 23 from the point of having axial surface projection, the rotor canister man be formed without such tube and with the bearing bushes 26, 27 mounted directly in the canister end walls so that the axle 15 defines a stationery inner wall of the canister and the supply ports 17 open directly into the separation chamber of the canister.

Although in all of the above embodiments the centrifugal separator has been shown with the rotor committed to rotation about the axle in a clockwise direction and the axial discontinuities circumferentially displaced to suit, it will be appreciated that the rotor canister may be arranged to have the reaction jet nozzles oppositely directed whereby it undergoes rotation in an anti-clockwise direction about the axis, and with any circumferential displacement of the radially outer regions of the axial displacements also oppositely directed from that illustrated.

It will also be appreciated that the rotor separation funnel arrangement and the provision of such non-radial axial displacements is not limited to rotor canisters of the sealed or discardable type and may be employed with different types of canister construction that are known in the art and permit dis-assembly for cleaning and the like.

What is claimed is:

1. A rotor for a self-powered centrifugal separator for separating particulate contaminants from a liquid supplied to the separator at elevated pressure, said rotor comprising a canister arranged to spin about a rotation axis, having an outer, peripheral wall including a peripheral side wall displaced from the rotation axis and at least one end wall, an internal partition wall extending radially inwardly from the peripheral wall dividing the canister into a separation chamber and an outflow chamber and defining at its radially inner periphery a transfer aperture between the separation and outflow chambers, said separation chamber including an inlet aperture to admit contaminated liquid, and the outflow chamber having at least one nozzle spaced radially from said rotation axis to eject liquid from the canister, and a rotor separation funnel arrangement within the separation chamber, the rotor separation funnel arrangement supported coaxially within the separation chamber and having an inclined surface generated about a longitudinal axis common to the rotation axis, and sloping downwardly towards the rotation axis from an upper end concentric with the separation chamber to a lower end apertured so as to direct liquid by way of said inclined surface to the transfer aperture.

2. A centrifugal separator rotor as claimed in claim 1 including at the end wall of the rotor canister opposite the outflow chamber, at the internal surface thereof, an array of axial discontinuities each extending radially, at least some of said axial discontinuities also extending circumferentially such that at radially outer regions said discontinuities are displaced circumferentially with respect to radially inwardly regions of said discontinuities in a direction that is trailing with respect to the rotation direction of the rotor that results from ejection of liquid from the canister.

3. A centrifugal separator rotor as claimed in claim 2 in which at least some of said axial discontinuities extend from adjacent the radially outer edge of the end wall to adjacent the radially inner edge of said end wall.

4. A centrifugal separator rotor as claimed in 2 in which said axial discontinuities are formed by embossments in the end wall comprising acceleration ribs of relatively narrow width in a circumferential direction and raised in height with respect to said canister end wall axially internally of the separation chamber formed by the wall.

5. A centrifugal separator rotor as claimed in claim 4 in which the acceleration ribs are of substantially uniform width along their length and of such width and axial height as to define strengthening ribs for said end wall of the canister.

6. A centrifugal separator rotor as claimed in claim 2 in which the axial discontinuities are formed by discrete acceleration vanes of thickness in a circumferential direction less than a length of said vanes, disposed on a carrier member adjacent to, and overlying, said end wall, and extend on said carrier in said axial, radial and circumferential directions.

7. A centrifugal separator rotor as claimed in claim 6 in which the carrier is formed as a unitary structure with the separation funnel arrangement.

8. A centrifugal separator rotor as claimed in claim 2 including axial discontinuities which terminate adjacent the radially inner end of the canister end wall in a substantially radial direction.

9. A centrifugal separator rotor as claimed in 2 in which at least some of said axial discontinuities terminate adjacent the radially inner edge of the wall and extend tangentially relative to an inner peripheral wall of said canister.

10. A rotor separation funnel arrangement for a rotor of a self-powered centrifugal separator for separating particulate contaminants from a liquid supplied to said separator at elevated pressure, which rotor comprises a canister, arranged to spin about an operationally substantially vertical rotation axis, having i) an outer, peripheral wall including a peripheral side wall displaced from the axis and at least one end wall, and (ii) an internal partition wall extending radially inwardly from the peripheral wall dividing the canister into a separation chamber at an upper end and an outflow chamber at a lower end, and defining at its radially inner periphery a transfer aperture between the separation and outflow chambers, said separation chamber including an inlet aperture to admit contaminated liquid to said separation chamber, the outflow chamber having at least one nozzle spaced radially from said rotation axis to eject liquid from the canister, said rotor separation funnel arrangement being arranged to be supported coaxially within the separation chamber, having an inclined surface, generated about a longitudinal axis common to the rotation axis, and sloping downwardly towards the rotation axis from an upper end concentric with the separation chamber to a lower end apertured so as to direct liquid by way of said inclined surface to the transfer aperture, said inclined surface of the funnel arrangement having alternately arrayed about the rotation axis a plurality of upstanding separation ribs and through-apertures, said separation ribs extending in a direction between the upper and lower ends of the funnel arrangement and defining between adjacent ribs separation channels in which said inclined surface forms deposition surfaces including said through-apertures, said separation ribs being of such height with respect to the deposition surfaces to create, in use, within the liquid of the rotating canister that is constrained by the arrangement within the vicinity of the inclined surface, particulate separation eddy currents operable to deposit particulate materials separated from the liquid at the deposition surfaces, said through-apertures comprising scavenging apertures positioned in the separation channels and dimensioned to permit said separated particulate materials that are susceptible to displacement with respect to the deposition surface by centrifugal forces to pass by way of said apertures towards the peripheral side wall of the separation chamber below the funnel arrangement, with at least some of the liquid flowing in the separation channels, said separation funnel arrangement also including at least one return aperture, positioned at or near the lower end of the inclined surface and dimensioned to permit liquid received into the region of the separation chamber below the funnel arrangement by way of the scavenging apertures to flow to said transfer aperture between separation and outflow chambers.

11. A rotor separation funnel arrangement as claimed in claim 10 in which said upper end of the separation funnel arrangement is dimensioned to contact in use the outer peripheral wall of said canister within the separation chamber.

12. A rotor separation funnel arrangement as claimed in claim 11 in which said upper end of said separation funnel arrangement is arranged to make said contact with a part of the peripheral wall defining an end wall of the canister and radially inwardly of the peripheral side wall.

13. A rotor separation funnel arrangement as claimed in claim 10 arranged to be supported in use by the partition wall of the canister.

14. A rotor separation funnel arrangement as claimed in claim 13 including axially extending leg members arranged to extend in use into the transfer aperture and support the separation funnel arrangement of the partition wall.

15. A rotor separation funnel arrangement as claimed in claim 14 in which the funnel arrangement comprises a unitary molding of plastics material and in which the leg members include resilient detent lugs arranged to locate the funnel arrangement in use with respect to the partition wall surrounding the transfer aperture.

16. A rotor separation funnel arrangement as claimed in claim 10 in which the separation ribs are formed integrally with the inclined surface.

17. A rotor separation funnel arrangement as claimed in claim 16 comprising a unitary molding.

18. A rotor separation funnel arrangement as claimed in claim 10 in which there are a plurality of scavenging apertures in each separation channel spaced apart in line between said upper and lower ends of the funnel arrangement.

19. A centrifugal separator for separating particulate contaminants from a liquid supplied to said separator comprising a housing enclosure, an axis extending through the housing enclosure in an operationally substantially vertical orientation, and wherein a rotor is arranged to receive a liquid at elevated pressure and, in reaction to ejection of the liquid substantially tangentially from said rotor spin about the axis at at least a predetermined minimum speed to effect separation of said contaminant particles from contaminated liquid therein, said rotor comprising a canister arranged to spin about a rotation axis, having an outer, peripheral wall including a peripheral side wall displaced from the rotation axis and at least one end wall, an internal partition wall extending radially inwardly from the peripheral wall dividing the canister into a separation chamber and an outflow chamber and defining at its radially inner periphery a transfer aperture between the separation and outflow chambers, said separation chamber including an inlet aperture to admit contaminated liquid, and the outflow chamber having at least one nozzle spaced radially from said rotation axis to eject liquid from the canister, and a rotor separation funnel arrangement within the separation chamber, the rotor separation funnel arrangement supported coaxially within the separation chamber and having an inclined surface generated about a longitudinal axis common to the rotation axis, and sloping downwardly towards the rotation axis from an upper end concentric with the separation chamber to a lower end apertured so as to direct liquid by way of said inclined surface to the transfer aperture.

* * * * *